US009759102B2

(12) United States Patent
Busse

(10) Patent No.: US 9,759,102 B2
(45) Date of Patent: Sep. 12, 2017

(54) HYDRAULIC CAMSHAFT ADJUSTER HAVING A LOCKING PIN FOR CENTRE-LOCKING PROVIDED FOR CONTROLLING A HYDRAULIC MEDIUM

(71) Applicant: Schaeffler Technologies AG & Co. KG, Herzogenaurach (DE)

(72) Inventor: Michael Busse, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/774,753

(22) PCT Filed: Dec. 11, 2013

(86) PCT No.: PCT/DE2013/200351

§ 371 (c)(1),
(2) Date: Sep. 11, 2015

(87) PCT Pub. No.: WO2014/146626

PCT Pub. Date: Sep. 25, 2014

(65) Prior Publication Data

US 2016/0024979 A1 Jan. 28, 2016

(30) Foreign Application Priority Data

Mar. 20, 2013 (DE) ..... 10 2013 204 928

(51) Int. Cl.
*F01L 1/34* (2006.01)
*F01L 1/344* (2006.01)

(52) U.S. Cl.
CPC ..... *F01L 1/3442* (2013.01)

(58) Field of Classification Search
CPC ..... F01L 1/3442; F01L 1/344
(Continued)

(56) References Cited

U.S. PATENT DOCUMENTS 6,941,912 B2 9/2005 Palesch et al.
9,080,471 B2 7/2015 Pluta et al.
(Continued)

FOREIGN PATENT DOCUMENTS

DE 10205415 8/2003
DE 102007028187 12/2008
(Continued)

*Primary Examiner* — Zelalem Eshete
(74) *Attorney, Agent, or Firm* — Davidson, Davidson & Kappel, LLC

(57) ABSTRACT

A hydraulic camshaft adjuster, including a rotor and a stator and a hydraulic medium management system, by which at least two chambers separated by a rotor-fixed vane can be or are connected to a hydraulic medium supply device and/or hydraulic medium discharge device by an interposed hydraulic valve, wherein the vane contains a switchable hydraulic medium control device designed for selective release and interruption of a fluid connection from one chamber to the other chamber. A locking device for excluding a rotational movement between the rotor and the stator locks the rotor to the stator in a vane position in which the volume of the two chambers is approximately equal, and includes a pin, interlockable with a stator-fixed component, designed to control the inflow and/or outflow of hydraulic medium to/from a chamber.

11 Claims, 15 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 2006/0086332 | A1* | 4/2006 | Simpson | F01L 1/022 123/90.17 |
| 2010/0269772 | A1* | 10/2010 | Takemura | F01L 1/022 123/90.17 |
| 2011/0088645 | A1 | 4/2011 | Yamaguchi et al. | |
| 2012/0073531 | A1 | 3/2012 | Urushihata | |
| 2013/0025553 | A1 | 1/2013 | Busse et al. | |

FOREIGN PATENT DOCUMENTS

| | | | |
|---|---|---|---|
| DE | 102010019530 | | 11/2011 |
| DE | 112011103646 | T5 | 8/2013 |
| EP | 1371818 | | 12/2003 |
| WO | WO2009/114500 | | 9/2009 |
| WO | WO2012094324 | | 7/2012 |

* cited by examiner

HYDRAULIC CAMSHAFT ADJUSTER HAVING A LOCKING PIN FOR CENTRE-LOCKING PROVIDED FOR CONTROLLING A HYDRAULIC MEDIUM

The present invention relates to a vane-type hydraulic camshaft adjuster, which includes a rotor and a stator as well as a hydraulic medium conducting system, such as an oil conducting system, which has at least one first, second and third hydraulic medium line, at least two chambers separated by a rotor-fixed vane being connectable or connected to a hydraulic medium supply and/or hydraulic medium discharge device with the aid of the oil conducting system by interposing a hydraulic valve, a switchable hydraulic medium control device being furthermore present in the vane, which is designed to selectively release and interrupt a fluid connection, such as a line, a channel or an opening, from one chamber to the other chamber, a locking device being additionally present for preventing a rotational movement between the rotor and the stator, the locking device being designed to lock the rotor to the stator in a vane position, in which the vane is situated between the two end stop positions, i.e., between ADVANCE and RETARD, and/or in which the two chambers have a volume of approximately the same size, i.e., the vane is in a central position, and the locking device including at least one pin which is able to establish a form-locked fit with a stator-fixed component or is engaged therewith, such as a locking pin, a locking bolt, a locking piston or a locking journal.

BACKGROUND

A locking bolt in a vane-type camshaft adjuster is already known from the prior-art EP 1 371 818 A2.

A vane-type hydraulic camshaft adjuster is also known from WO 2009/114500 A1, a center-locking mechanism, in which the vane is locked in a central position, being implemented with the aid of a locking pin.

Hydraulic camshaft adjuster systems having center-locking mechanisms as well as hydraulic camshaft adjuster systems which operate according to the vane principle are thus known. They make it possible to adjust the control times of an internal combustion engine during engine operation.

When starting the engine, if the oil pressure in the engine has not yet been built up, a hydraulic camshaft adjuster must be mechanically fixed. This is necessary to prevent uncontrolled oscillation and thus a noise development. "Startup rattling" should also be mentioned in this connection, which should be stopped. An end stop locking in a so-called "RETARD" or "ADVANCE" position is standard practice here. The vane of the rotor strikes the stator. The movement in the other rotation direction is prevented by a mechanical locking element. This element may be placed axially or radially in the camshaft adjuster.

A mechanical fixing of the rotor between the two RETARD and ADVANCE end stops is rarely implemented but is being required more and more of automotive manufacturers. One speaks of a center-locking mechanism in this case. Due to the fact that few energy sources may be tapped during the center-locking process, and the initial position may be on the retard or advance side, a center-locking is much more difficult to implement than an end stop locking in the retard or advance position.

SUMMARY OF THE INVENTION

It is an object of the present invention to provide an improvement in the area of center-locking, in particular such an improvement that a better control is achieved at lower rotational speeds, resulting in a good control which may be implemented independently of the engine control unit.

The fact that the adjustment is greatly dependent on the existing camshaft alternating torque during engine operation is to be prevented. This may present a problem at negative engine oil temperatures, i.e., when temperatures are far below 0° C. Namely, the friction in the camshaft bearing increases significantly in this state, so that in sum a camshaft alternating torque undergoes a unilateral shift. This means that an extremely pronounced camshaft alternating torque is present in the adjusting direction toward RETARD, while a very small camshaft alternating torque is present in the other adjusting direction, namely toward ADVANCE. The center-locking mechanism built into this adjusting system works only in connection with a so-called CTA system (Camshaft Torque-Actuated System). At present, this function cannot be integrated into a conventional hydraulic camshaft adjusting system (OPA system—Oil Pressure-Actuated System), a situation which, however, is to be changed.

The present invention provides a hydraulic camshaft adjuster having a pin, preferably assembled as a locking or control piston, to control the inflow and/or outflow of hydraulic medium to/from a chamber.

In this way, a reliable center-locking mechanism is implemented, so that the engine, i.e., the internal combustion engine, may always start the next time the engine is started. The rotor may be locked relative to the stator in its center-locking position while the internal combustion engine is stopped, independently of the angle position of the vane in the stator prior to stopping the internal combustion engine and within the shortest period of time. No adjustment at the engine control unit is required. Furthermore, no additional installation space outside the camshaft adjuster is needed.

In this way, a hydraulic freewheeling locking mechanism is ultimately implemented. It is activated when the hydraulic valve is deenergized. The freewheeling locking mechanism is deactivated again as soon as the hydraulic valve is energized for the purpose of an adjustment. The hydraulic valve may be activated by an engine control unit by interposing a magnet of variably determinable strength.

Advantageous specific embodiments are explained in greater detail below.

It is thus advantageous if the locking device includes two locking pins, namely an advance locking pin and a retard locking pin. In this way, a movement of the vane into the advance chamber and also into the retard chamber is preventable.

To achieve a mechanically loadable locking, it is advantageous if the stator-fixed component is designed as a sealing cover which includes at least one or two preferably kidney-shaped recesses for the form-locked accommodation of one or both locking pins at least on one side. The kidney shape has advantages for the engagement of one or both pins with this/these recess(es) to facilitate a problem-free resting of the corresponding pin against the recess/recesses on at least one side. In this way, at least one form-locked fit is forced in one rotation direction.

It has also proven to be advantageous if the advance locking pin is designed to engage with the stator-fixed component when the vane is in an ADVANCE adjustment position or in a central position, and/or when the retard locking pin is designed to engage with the stator-fixed component when the vane is in a RETARD adjustment position or in the central position. Instead of an engagement from the front, an engagement from behind may also be desired.

To ensure a failsafe adjustability even if the oil pressure drops, it is advantageous if the locking pin is spring-loaded in such a way that it is pushed out of the rotor in the absence of a counter-force.

It is also advantageous for the function if the advance locking pin is designed to interrupt a first hydraulic medium line to a chamber, for example the advance chamber, in its state extended from the rotor.

The hydraulic medium control device may be designed to be particularly cost-effective if the switchable hydraulic medium control device includes a control piston having an oil conducting groove running around its outer circumferential surface.

If the control piston is spring-preloaded in such a way that it is pushed into a position which releases the fluid connection in the absence of a counter-force, and/or via a second hydraulic medium line to the control piston upon the provision of hydraulic pressure, it is pushed into a position which interrupts the fluid connection, and/or the second hydraulic medium line is also designed, situated or connected for conducting hydraulic medium to one or both locking pins, for the purpose of providing a counter-force against the existing spring. The spring is a mechanical spring, such as a tension spring or a pressure spring, in particular a helical spring, which may also be used elsewhere to provide spring force.

One advantageous exemplary embodiment is also characterized in that a first check valve is situated on or in the fluid connection in the vane to prevent the hydraulic medium flow from the one chamber into the other chamber, preferably from the advance chamber into the retard chamber, and/or a second check valve is present in another vane in the opposite active direction to the first check valve. In the first of the two cases, a progression of the vane in the ADVANCE direction is achieved, while in the second of the two cases, a progression in the RETARD direction is ensured.

For a good force distribution, it is advantageous if four or five vanes are present, distributed equally on the rotor.

In other words, one could also say that the hydraulic camshaft adjusting system having a center-locking mechanism includes a hydraulic camshaft adjuster and a hydraulic valve. The hydraulic valve may be designed as a cartridge valve or a central valve.

In addition to the known standard components, such as a rotor and a stator, the camshaft adjuster also has a (further) locking unit, a check valve and a control piston unit in each vane. Each control piston unit, in turn, includes a control piston, a pressure spring and a guiding element. A bore is introduced into the control piston itself. Parallel thereto, bores are also provided in each vane, which connect an advance chamber (chamber A) to a retard chamber (chamber B) in each chamber pair. This connection is also interruptible by the control pistons. For this purpose, oil pressure must be applied to the control pistons, which must be pushed against the pressure spring. A check valve is situated in or on one of the multiple existing vanes. A check valve may be designed as a ball check valve or a plate check valve. Similar types of check valves may also be used. This prevents the oil, which is used as the hydraulic medium, from flowing out of first chamber A into a first chamber B, i.e., from the advance chamber into the retard chamber.

In the other vanes connected to the rotor, the oil may flow in both directions. In one modification, however, a check valve may also be installed therein, which also operates, as needed, in an active direction other than that of the first check valve. It is advantageous if a first check valve, which acts in a first direction, is inserted into a first vane, and a second check valve, which acts opposite the active direction of the first check valve, is inserted into a second vane.

Two locking pins are inserted into the locking device.

A first locking pin is referred to as the advance locking pin, and a second locking pin is referred to as the retard locking pin. The retard locking pin prevents an oscillation of the vane in the RETARD direction and conversely the advance locking pin prevents an oscillation in the ADVANCE direction. It is, however, worth noting that the advance locking pin, which could also be referred to as the locking piston, has a circumferential groove, with the aid of which an additional switching function is achievable, using the hydraulic medium, such as oil.

In the locked state, the advance locking pin separates the oil line between the hydraulic valve and the advance chamber (chamber A1). In the unlocked state, this connection is reestablished. The other chambers ($A_n$) remain unaffected by this interruption and are always connected to the hydraulic valve.

The hydraulic valve is a proportional valve having five ports and four piston positions. The ports are the oil feed, the oil discharge, chamber ports A and B and control line C. All ports are either open or closed, depending on the piston position in the hydraulic valve.

The strategy in this process is that the camshaft adjuster finds the center-locking position itself and remains there until it is unlocked again. The locking action is initiated by the "ignition off" signal when the internal combustion engine, i.e., the motor, stops.

Directly afterwards, the hydraulic valve is deenergized, and the camshaft adjuster begins to move in the direction of the center-locking position. If the camshaft adjuster was in the adjustment angle between RETARD and the center-locking position, the adjustment must take place in the ADVANCE direction. However, if the camshaft adjuster was in the angle position between ADVANCE and the center-locking position, the adjustment must take place in the RETARD direction. Depending on the adjusting direction, the adjustment takes place in different ways.

BRIEF DESCRIPTION OF THE DRAWINGS

The adjusting system and the principle are explained in greater detail below with the aid of a drawing. The different exemplary embodiments are illustrated therein.

DETAILED DESCRIPTION

Figure 1:
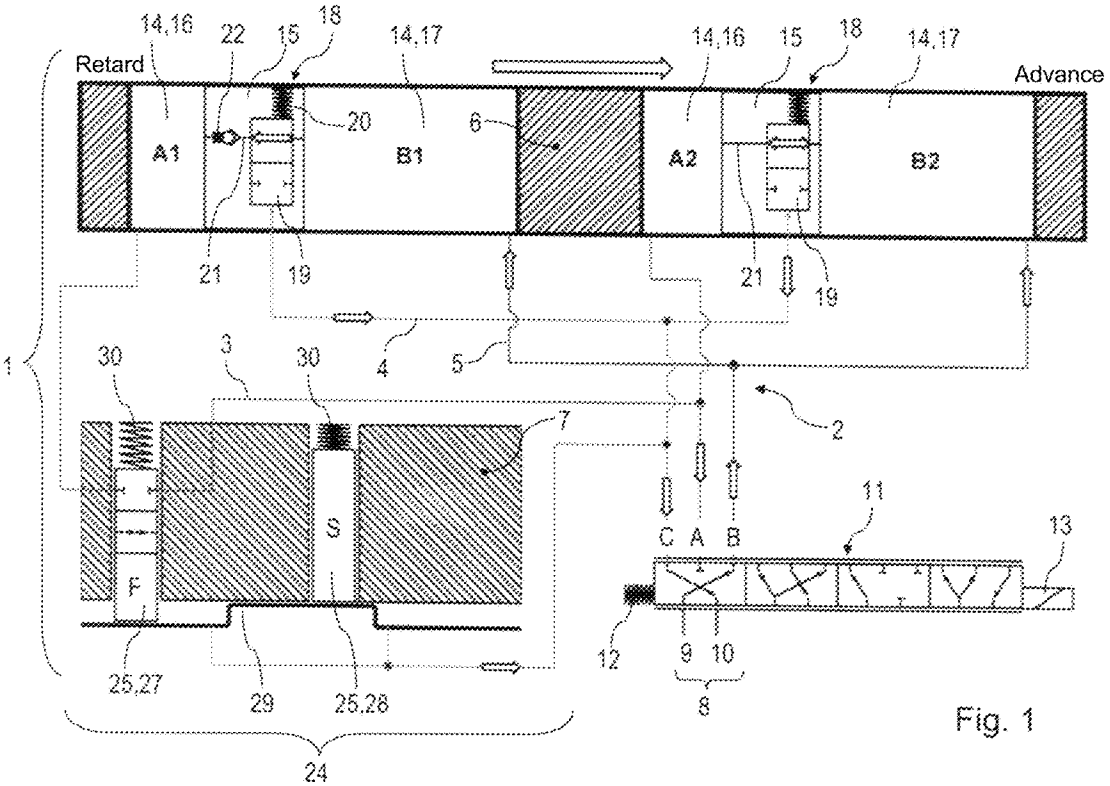
FIG. 1 shows a schematic function representation of a hydraulic camshaft adjuster, including components participating in the functioning, during the locking operation from RETARD while the engine is stopped.

The figures are only schematic and are used only for the sake of understanding the present invention. Identical elements are provided with identical reference numerals. Not all important elements are illustrated, and certain elements are illustrated which are not absolutely necessary for the present invention.

FIG. 1 shows a first specific embodiment of a hydraulic camshaft adjuster 1. This camshaft adjuster 1 is of the vane type and uses a hydraulic medium, such as oil. A hydraulic conducting system 2 is present, which could also be referred to as an oil conducting system. It includes a first hydraulic medium line 3, a second hydraulic medium line 4 and a third hydraulic medium line 5.

Camshaft adjuster 1 has, as usual, a stator 6 and a rotor 7.

A hydraulic medium supply and/or hydraulic medium discharge device 8 is connected to one end of first, second, third hydraulic medium lines 3 through 5. Hydraulic medium supply and/or hydraulic medium discharge device 8 includes an oil supply device 9 and an oil discharge device 10. A hydraulic valve 11 is connected between hydraulic medium conducting system 2 and hydraulic medium supply and/or hydraulic medium discharge device 8. Hydraulic valve 11 is situated between a spring element 12 and an electromagnet 13. Electromagnet 13 is supplied with variable current via an engine control unit, whereby the hydraulic valve or a piston in hydraulic valve 11 is movable.

Chambers 14 divided by vanes 15 are provided between stator 6 and rotor 7. An advance chamber 16 is present on the one side of each vane 15, and a retard chamber 17 is present on the other side of particular vane 15.

A hydraulic medium control device 18 is present in each vane 15. Hydraulic medium control device 18 includes at least one control piston 19. Control piston 19 is situated in all vanes in such a way that it is hydraulically actuatable and is resettable by a spring 20, and a fluid connection 21 between the two chambers 16 and 17 may selectively open or close. For this purpose, control piston 19 has a circumferential groove, which may be present inside control piston 19 or on its circumference. A straight channel may also be formed, which may have a partially open or closed cross section.

A first check valve 22 is also present in at least one vane 15.

Figure 16:
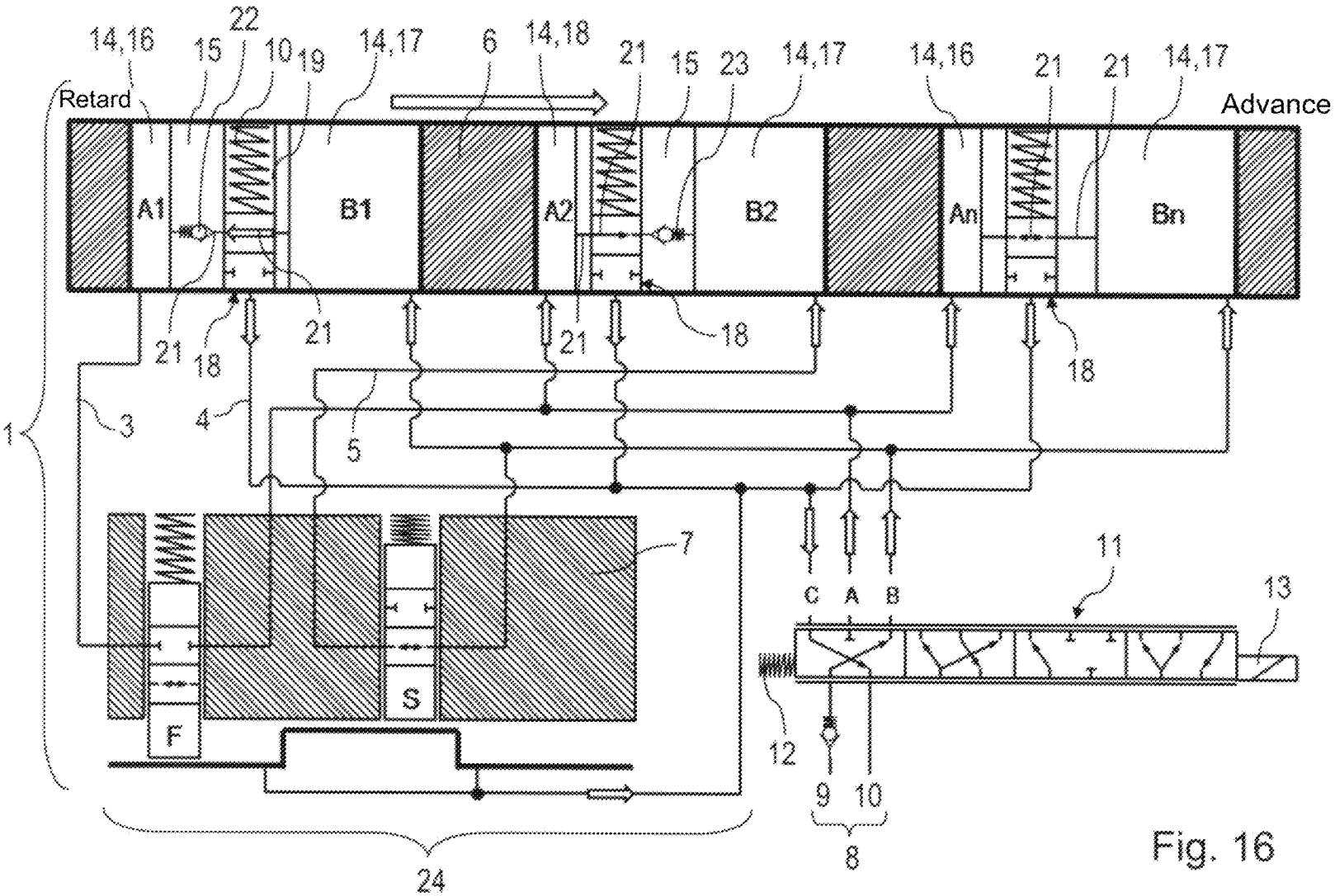
FIG. 16 shows a second exemplary embodiment of a hydraulic camshaft adjuster according to the present invention, in which a second check valve is mounted in a second vane, which acts in a direction other than that of a first check valve in a first vane, the camshaft adjuster being shown during the locking operation from RETARD while the engine is stopped.

As shown in the second exemplary embodiment, with reference to FIG. 16, a second check valve 23 may also be inserted into another vane 15, this second check valve 23 acting in the opposite direction than first check valve 22, i.e., it closes instead of opens when oil flows from retard chamber 17 into advance chamber 16.

Figure 6B:
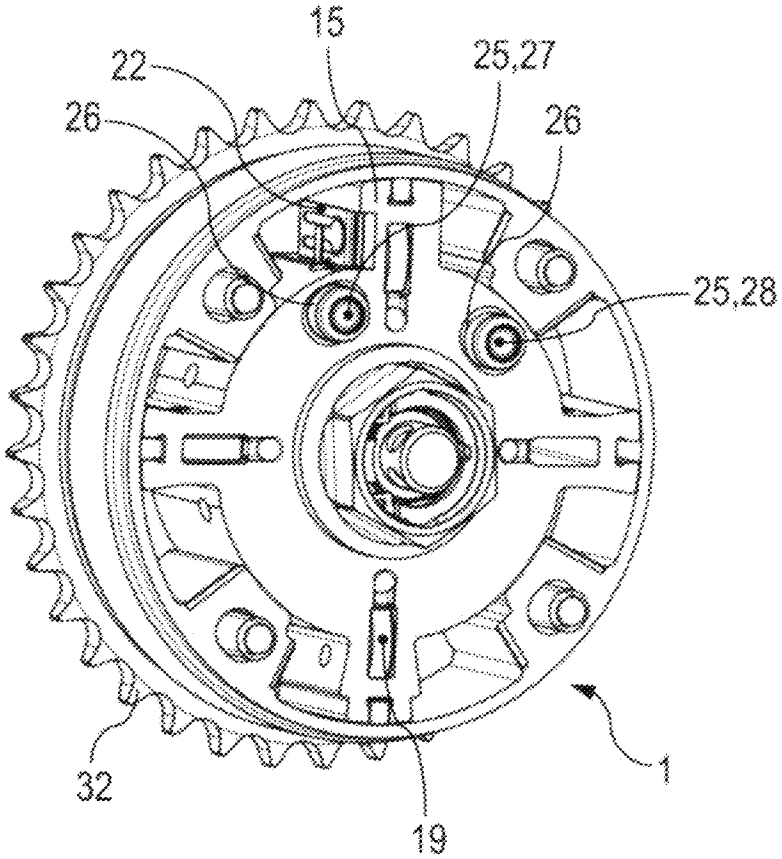
FIG. 6*b* shows a partial sectional perspective view of the hydraulic camshaft adjuster in the first exemplary embodiment, from a front side.
Figure 6A:
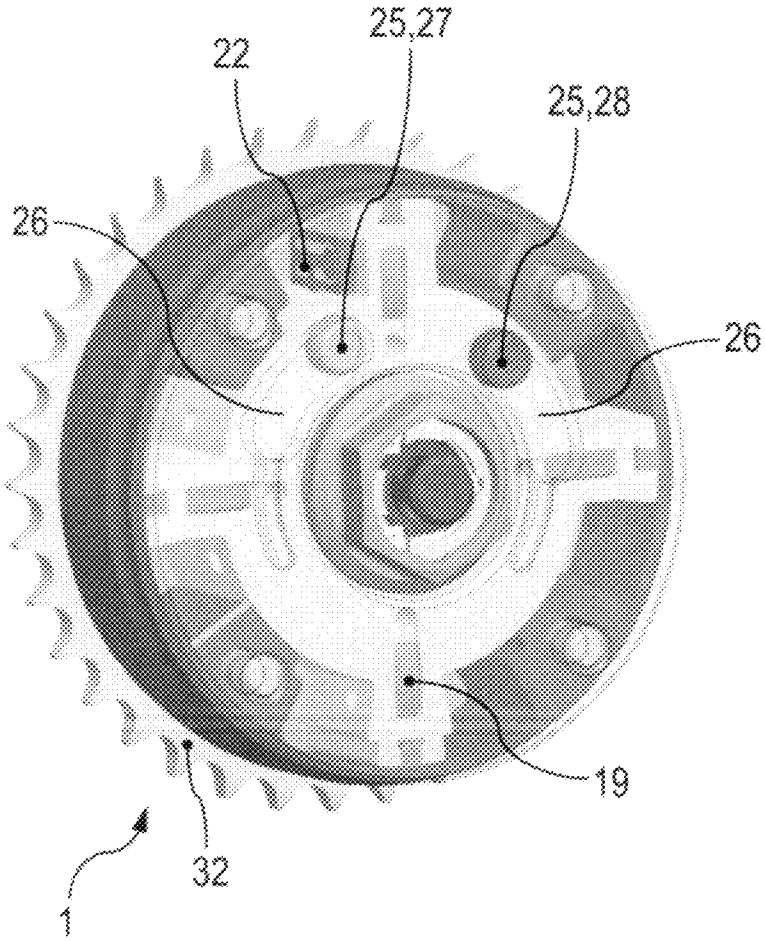
FIG. 6*a* shows a partially transparent representation of a camshaft adjuster according to the present invention in the first specific embodiment.

To return to FIG. 1, let it be noted that a locking device 24 is present, which includes two locking pins 25. Locking pins 25 may establish a form-locked fit with a recess 26 or multiple recesses 26, as illustrated in FIGS. 6*a* and 6*b*.

Recess 26 may also be kidney-shaped for each of the two locking pins 25. There is also a locking pin 25 to be referred to as advance locking pin 27 as well as a locking pin 25 to be referred to as retard locking pin 28. These two locking pins 25 may come into form-locked contact with locking contour 29 on a stator-fixed component, such as a sealing cover. Both locking pins 25 are spring-preloaded via a spring 30. A feed line of the second hydraulic medium line is present on the side of the locking pins facing away from the spring to be able to build up counter-pressure to spring 30.

Advance locking pin 27 is provided with hydraulic medium conducting contours, in particular for interrupting first hydraulic medium line 3, as illustrated in FIG. 1.

Advance locking pin 27 may also be provided with reference letter F, just as retard locking pin 28 may be provided with reference letter S. First hydraulic medium line 3 may also be designated by capital letter A, while second hydraulic medium line 4 may be designated by capital letter C and third hydraulic medium line 5 may be designated by capital letter B.

Advance locking pin 27 is movably supported in rotor 7, namely in the axial direction of the assembly, as is retard locking pin 28. They may also be radially movably supported.

By deenergizing the hydraulic valve in the case of the adjustment from the retard side when the engine is stopped, for the purpose of reaching a center-locking position and establishing a lock therein, oil pressure is applied to all retard chambers 17 in camshaft adjuster 1. At the same time, all advance chambers 16 (i.e., all A chambers) are closed off by hydraulic valve 11. No more oil is able to flow out of advance chambers 16 into a tank, i.e., reach oil discharge device 10.

In addition, the C port on the hydraulic valve is connected to the tank port, i.e., to oil discharge device 10. As a result, all control pistons 19 move into the position in which no oil pressure is applied and release the short-circuit bores between the two chambers 16 and 17.

Parallel thereto, the locking gates are also depressurized. Consequently, the two locking pistons 25, i.e., advance locking pin 27 and retard locking pin 28, are able to drop into the locking gates. In the case of an adjustment angle on the retard side, however, only advance locking piston 27 is able to do this. Retard locking piston 28 is not situated opposite its locking gate and remains pressed back in rotor 7. Since advance locking piston 27 is designed as a switching element, the oil line between chambers A1 and A2 is again interrupted. This is necessary to completely close chamber A1.

Camshaft adjuster 1 now begins to oscillate, due to the still existing camshaft alternating torque. Its oscillation in the desired ADVANCE adjusting direction presses the oil out of retard chambers 17 into advance chambers 16 via fluid connections 21 in vanes 15, which are designed as (short-circuit) bores.

An oscillation in the negative RETARD direction is not possible. Check valve 22 in first advance chamber 16 is closed during this movement, and the camshaft alternating torque may be supported on the oil cushion in advance chamber A1. On the whole, this results in a kind of free-wheeling movement. Rotor 7 progresses from an arbitrary retard position in the ADVANCE direction until advance locking piston 27 comes to a stop at the locking gate or locking contour 29. At the same time, retard locking piston 28 is opposite an open locking position and may also lock therein.

Camshaft adjuster 1 is now locked or mechanically fixed in a predefined lock position. Since the time between "ignition off" and the engine coming to a stop may be too short, and the camshaft adjuster may be unable to reach the center-locking position, a brief engine after-run of, e.g., 0.2 seconds may assist here. The exact time depends on the engine and must be ascertained through testing.

Another option is to overcome the residual adjustment angle when restarting the engine. The starter of the internal combustion engine alone generates sufficient camshaft alternating torques, which set the freewheeling in motion and adjust camshaft adjuster 1 in the direction of the center-locking position.

The oil pressure is also built up again when the engine starts. This helps to fill the supporting oil chamber, i.e., advance chamber 16 (A1), with oil and support the camshaft alternating torque in the ADVANCE direction.

Figure 2:
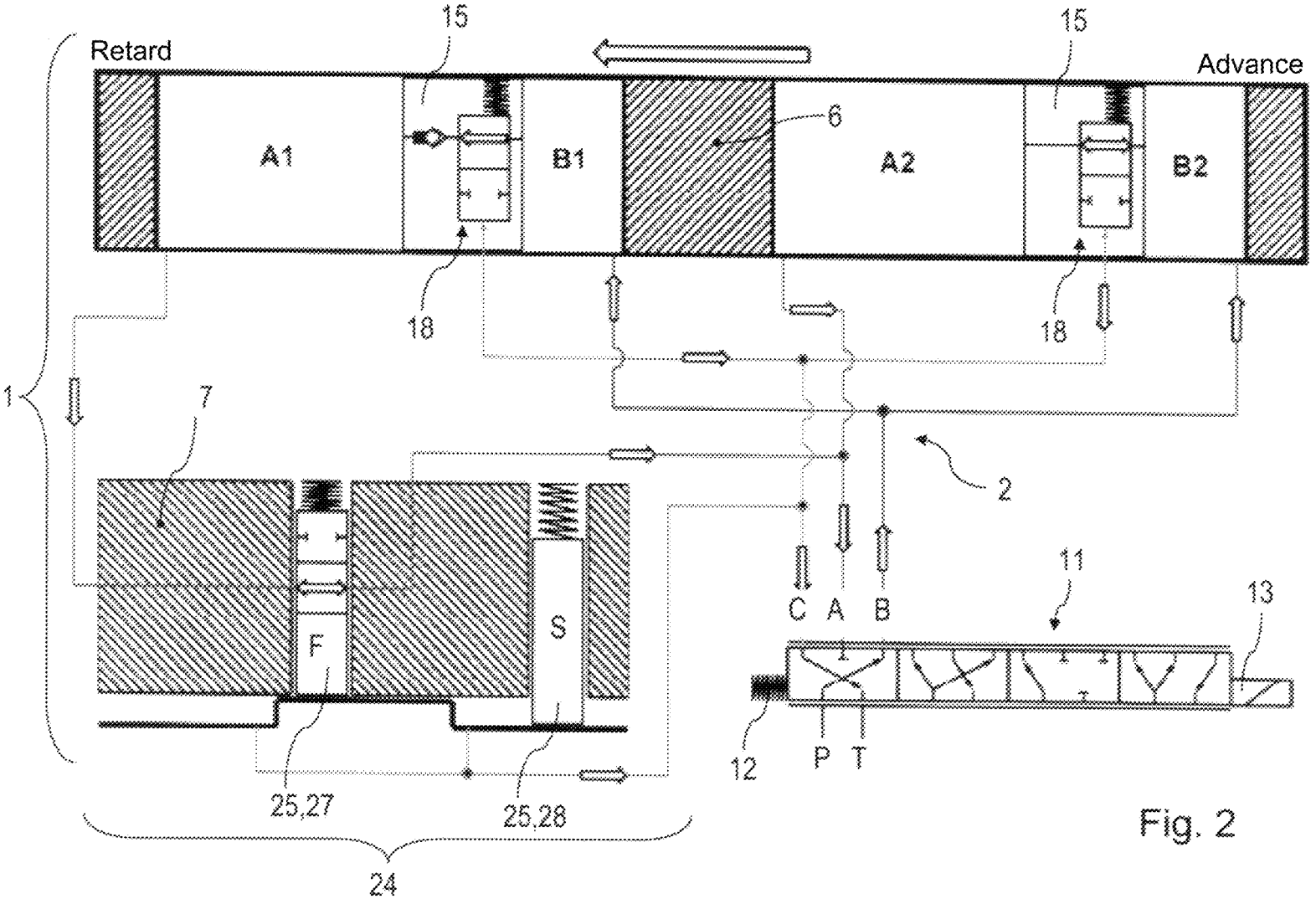
FIG. 2 shows the hydraulic camshaft adjuster from FIG. 1 during the locking operation from ADVANCE with a center stop.

FIG. 2 shows the adjustment from the advance side to the retard side while the engine is stopped, for the purpose of locking in the middle of the locking position. The adjustment in the RETARD direction differs from the adjustment in the ADVANCE direction primarily due to two features:

For a start, retard locking piston 28 is now locked and advance locking piston 27 is still pressed back in rotor 7. As a result, the oil line to chamber A1, i.e., to advance chamber 16, is not interrupted. Consequently, rotor 7 may also no longer be supported on the oil cushion in chamber A1.

The second distinguishing feature is the adjustment itself. The friction torque of the camshaft in the bearings is used for the adjustment. This friction torque always and reliably acts in the RETARD direction. Only the level of the friction torque is dependent on the engine oil temperature, which, in turn, affects the adjustment time. Should camshaft adjuster 1 fail to lock in the center-locking position (CLP), the locking operation is automatically resumed the next time the engine restarts and is locked until the first ignition spark.

Figure 3:
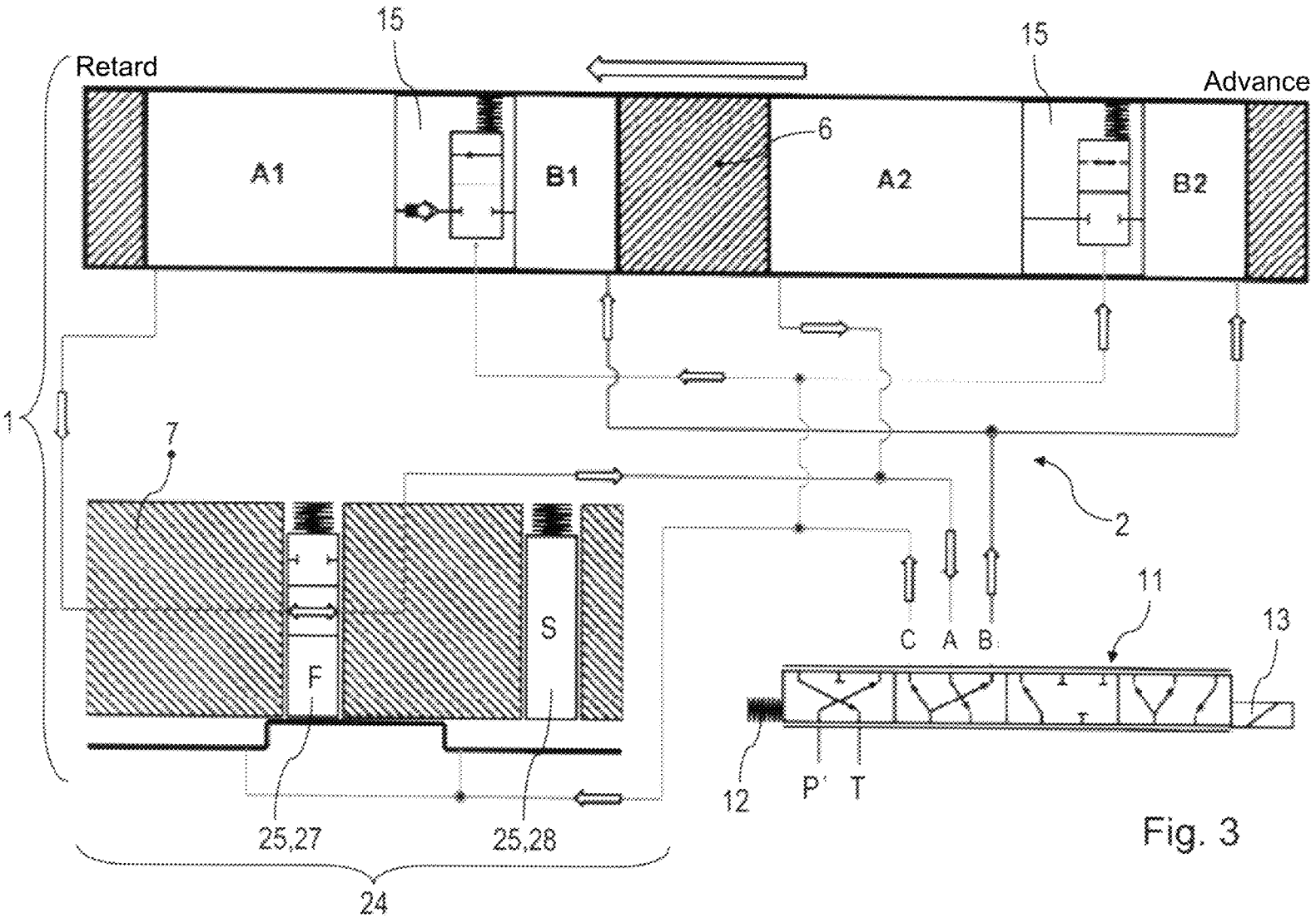
FIG. 3 shows the camshaft adjuster from FIGS. 1 and 2 during a normal adjustment from ADVANCE to RETARD in an operating internal combustion engine.
Figure 4:
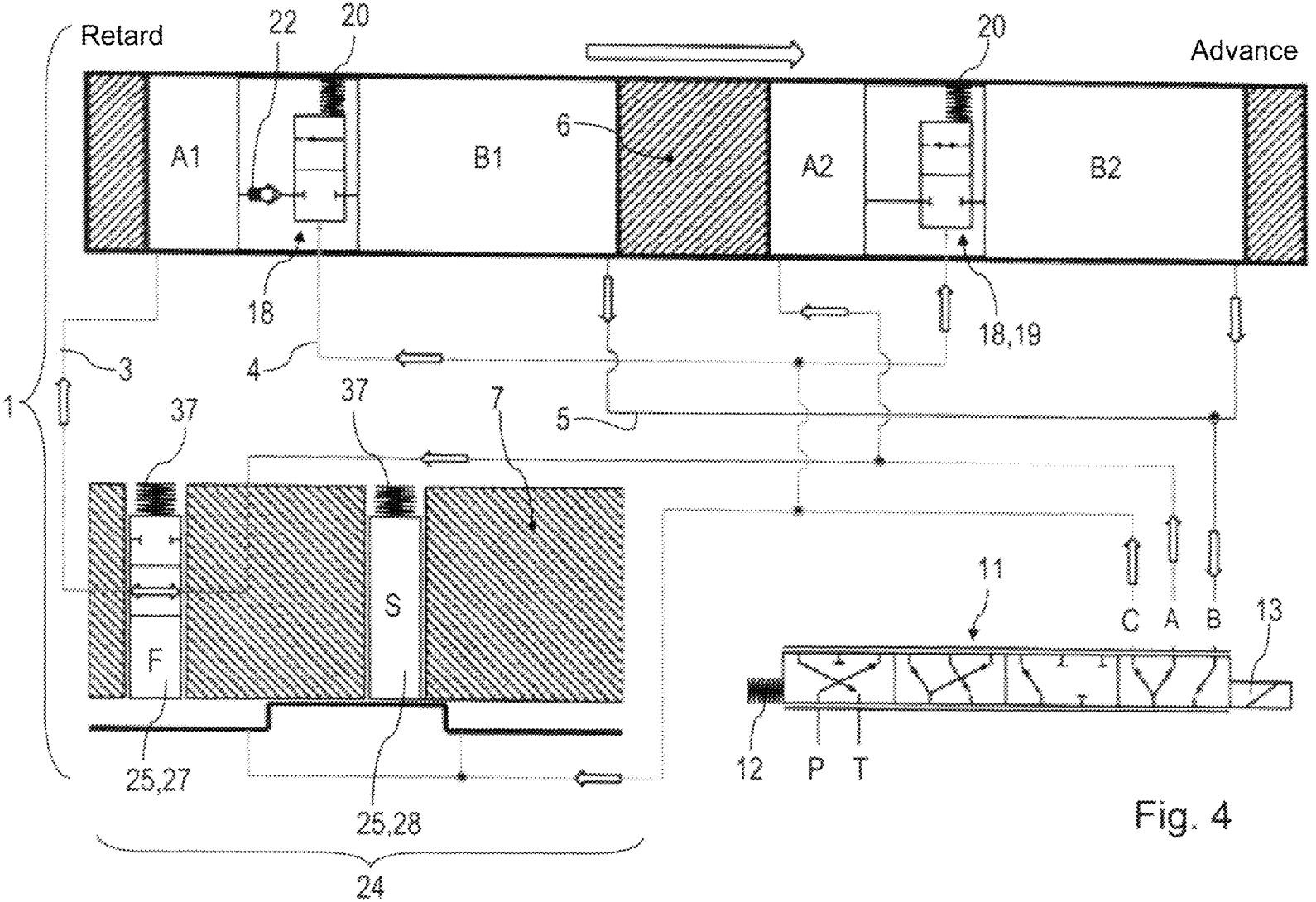
FIG. 4 shows the camshaft adjuster in the first exemplary embodiment in FIGS. 1 through 3 during an adjustment from RETARD to ADVANCE while the internal combustion engine is running.
Figure 5:
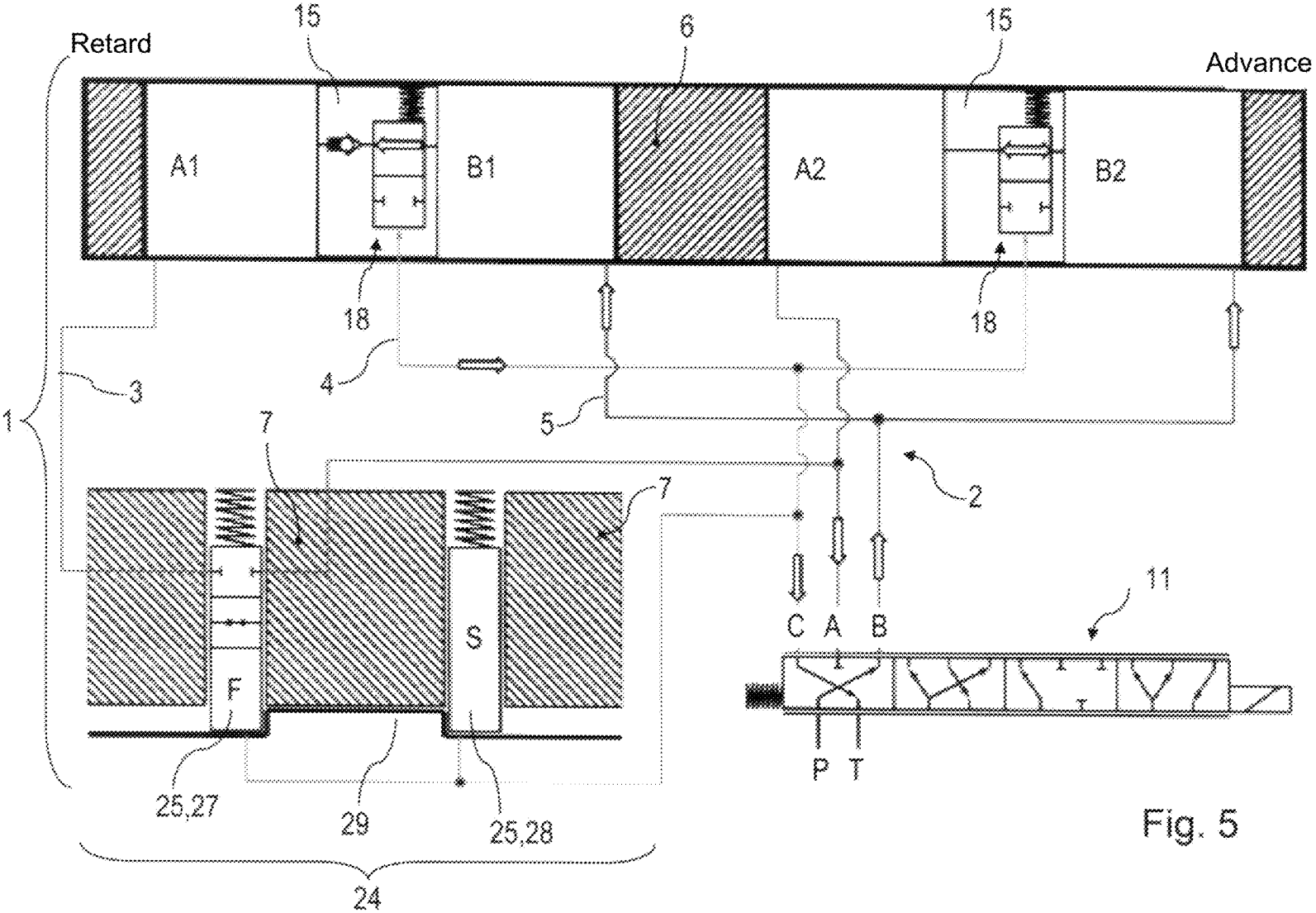
FIG. 5 shows the camshaft adjuster from the first exemplary embodiment in a locked center-locking position.

FIGS. 3 and 4 show the adjustment in both adjusting directions while the internal combustion engine is running During the engine operation, camshaft adjuster 1 may be adjusted in both adjusting directions via the center-locking positions. Port C on hydraulic valve 11 is permanently connected to oil supply P, i.e., to oil supply device 9. All control pistons 19 in vane 15 are thereby pressed into vanes 15 and interrupt the short-circuit bores, i.e., fluid connections 21. An oil exchange between advance and retard chambers 16 and 17 may take place. At the same time, locking pistons 25, i.e., advance locking pin 27 and retard locking pin 28, are pressed into rotor 7. Advance chamber 16 (A1) is thus connected to hydraulic valve 11, as are the other A chambers.

When camshaft adjuster 1 is fixed in the center-locking position, i.e. when it is locked, both locking pins 25, i.e., both advance locking pin 27 and retard locking pin 28, are in contact with locking contour 29. Locking contour 29 is situated between the two.

Figure 7:
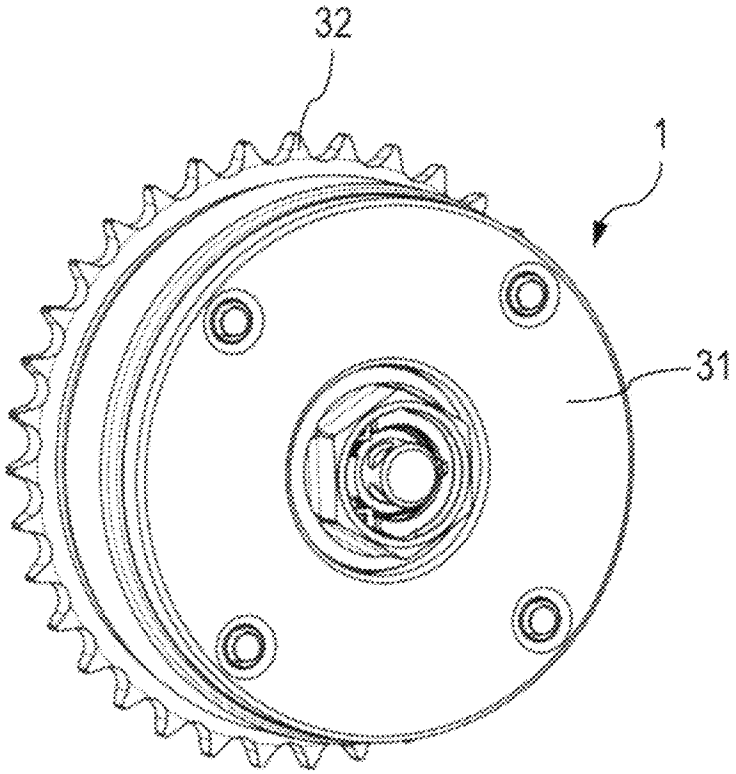
FIG. 7 shows a perspective view of the camshaft adjuster from FIG. 6 from a rear side.

A camshaft adjuster, including a central valve, is depicted from both sides, partially in a sectional view and partially in a transparent view, in FIGS. 6*a*, 6*b* and 7. A first check valve 22, made of sheet metal and having a sheet thickness of 0.25 mm, is situated on the advance chamber side of vane 15. Advance locking pin 27 may also be designated as locking piston F and is designed as a switching element. Four control pistons 19, including a spring 20 and a guiding element, are situated in equal distribution in camshaft adjuster 1, namely in rotor 7, and explicitly in vanes 15. Screwed-on sealing cover 31 is also readily apparent in FIG. 7, as is toothing 32 situated on the outside of the stator.

Figure 8:
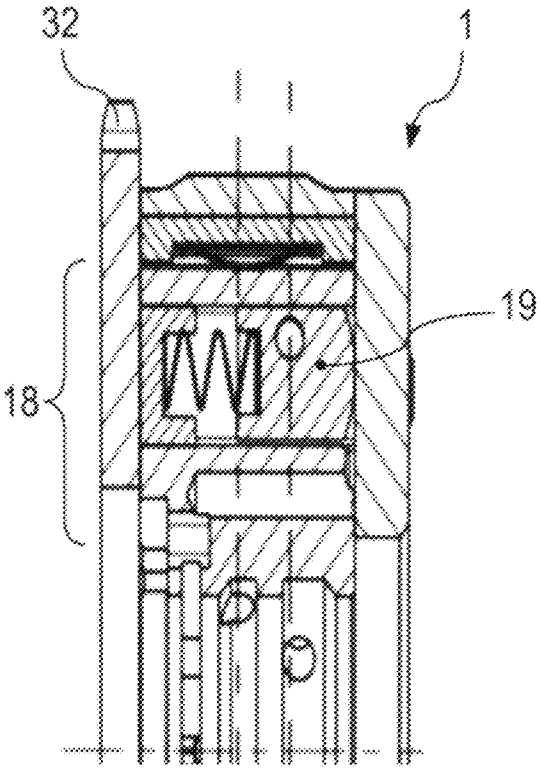
FIG. 8 shows a section of the camshaft adjuster from FIGS. 6 and 7 in the area of a hydraulic medium control device accommodating a control piston.

FIG. 8 shows a detail in a longitudinal sectional view of the camshaft adjuster from FIGS. 6*a* through 7, special attention having been given to control piston 19 as part of hydraulic medium control device 18.

Figure 9:
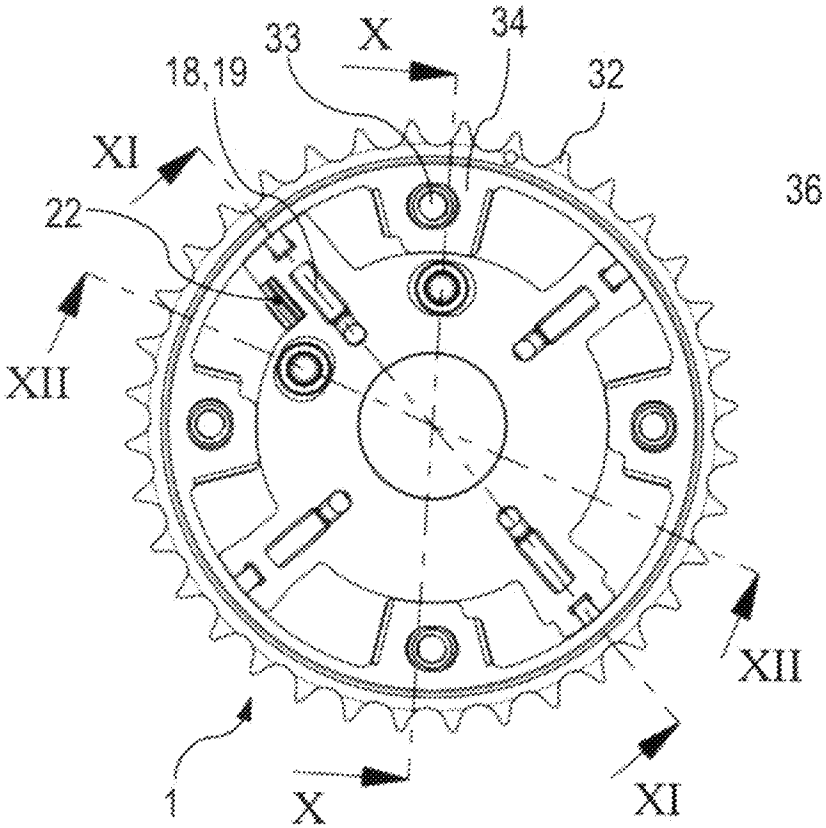
FIG. 9 shows a representation of the camshaft adjuster in a view from the front.

FIG. 9 shows a view of the camshaft adjuster along the longitudinal axis, screw connections 33, which may also be designed as rivet connections, being provided on inwardly extending projections 34 of stator 6.

Figure 10B:
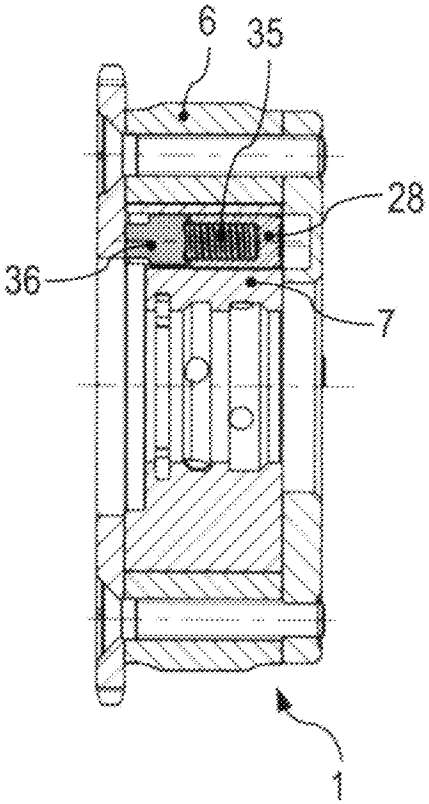
FIG. 10*b* shows a sectional view of the camshaft adjuster from FIG. 9 along line X, when the latter is in the unlocked state.
Figure 10A:
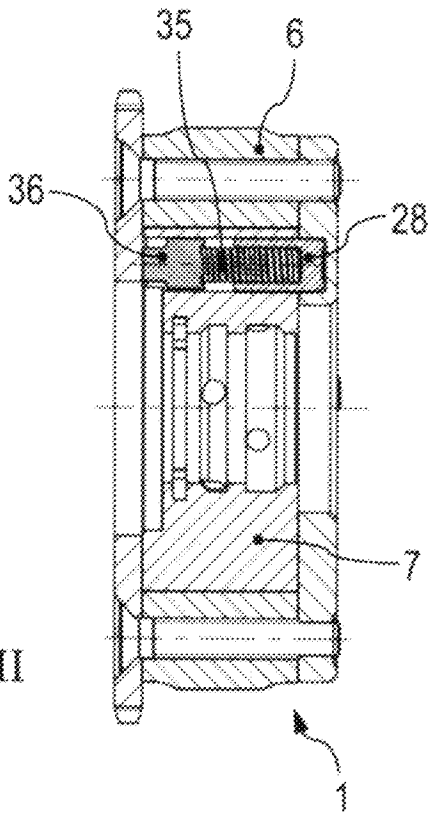
FIG. 10*a* shows a sectional view of the camshaft adjuster from FIG. 9 along line X, when the camshaft adjuster is in the locked state.

In FIGS. 10*a* and 10*b*, the locked state of camshaft adjuster 1 is visualized on the one hand, and the unlocked state of camshaft adjuster 1 is visualized on the other hand. A locking spring 35 is supported on a cartridge 36, and on particular locking pin 25, i.e., on a locking piston 25, represented here, in particular, as retard locking pin 28.

Figure 11B:
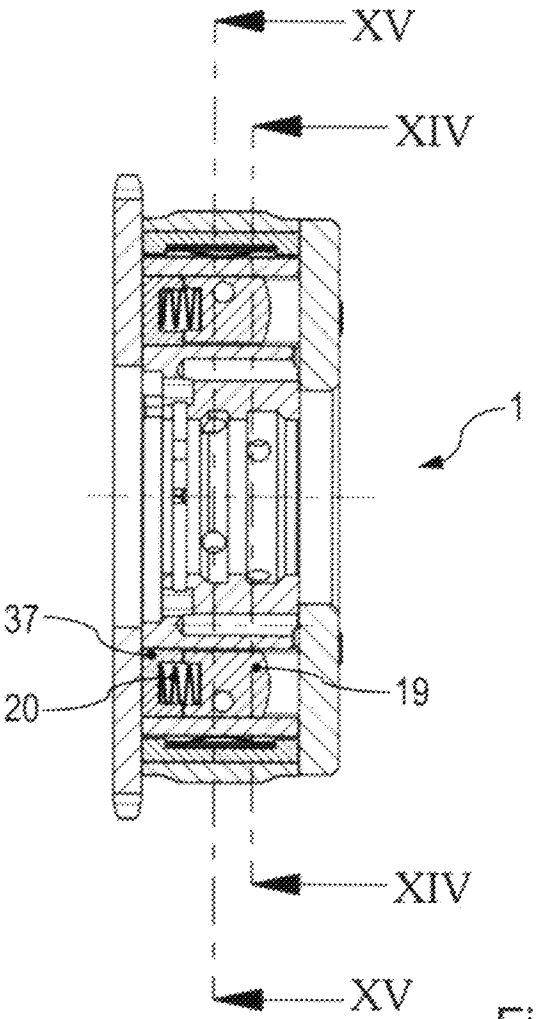
FIG. 11*b* shows a sectional view of the camshaft adjuster from FIG. 9 along line XI, when the fluid connection is blocked.
Figure 11A:
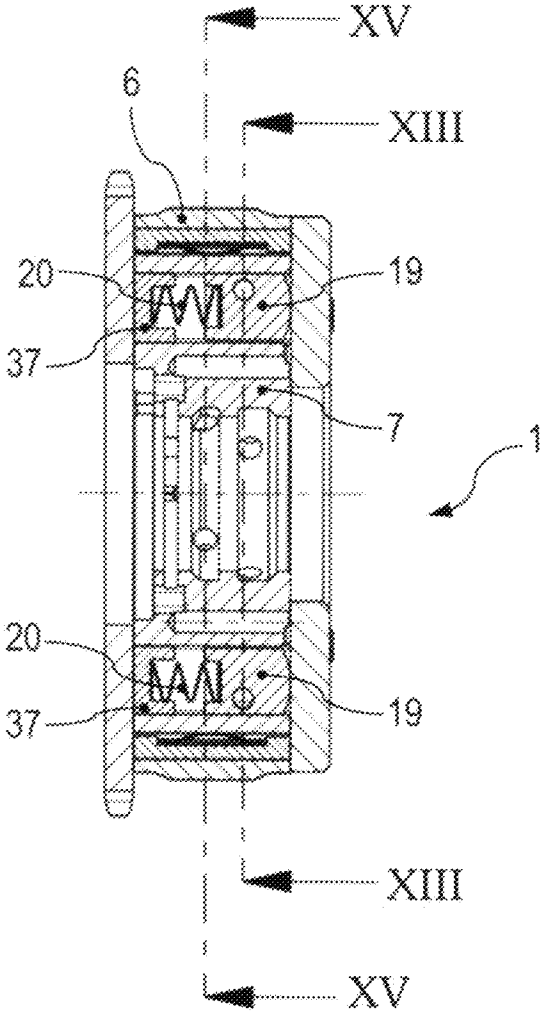
FIG. 11*a* shows a sectional view of the camshaft adjuster from FIG. 9 along line XI, when a fluid connection in the vane, e.g., a bore, a line, a channel or an opening, is unblocked.

FIGS. 11*a* and 11*b* show, firstly, the state in which fluid connection 21 designed as a bore is unblocked (FIG. 11*a*) and, secondly, the state in which it is blocked (FIG. 11*b*). Control piston 19 supports spring 20, which may also be referred to as the control piston spring, on one side in such a way that the control piston spring is caught between a guiding element 37 and control piston 19.

Figure 12B:
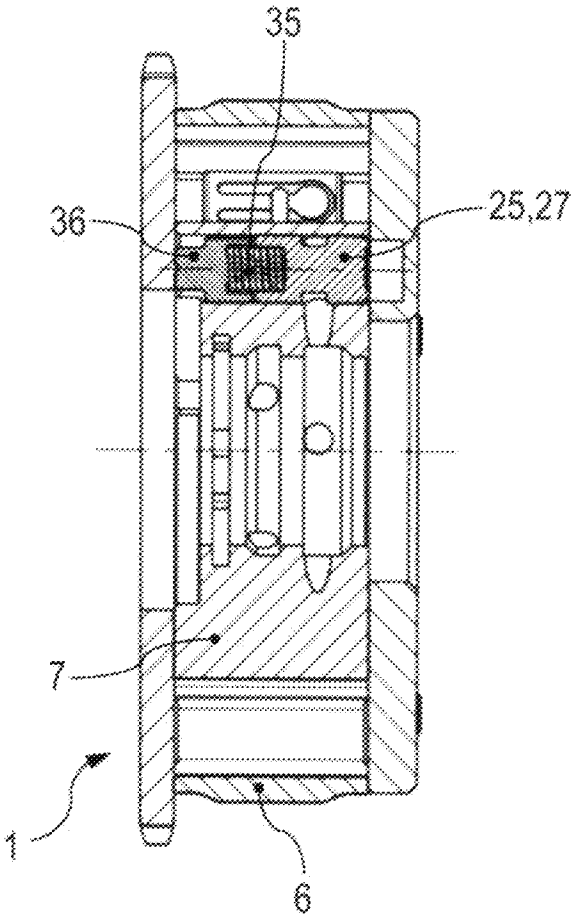
FIG. 12*b* shows a sectional view along line XII of the camshaft adjuster from FIG. 9 along line XII in the unlocked state.
Figure 12A:
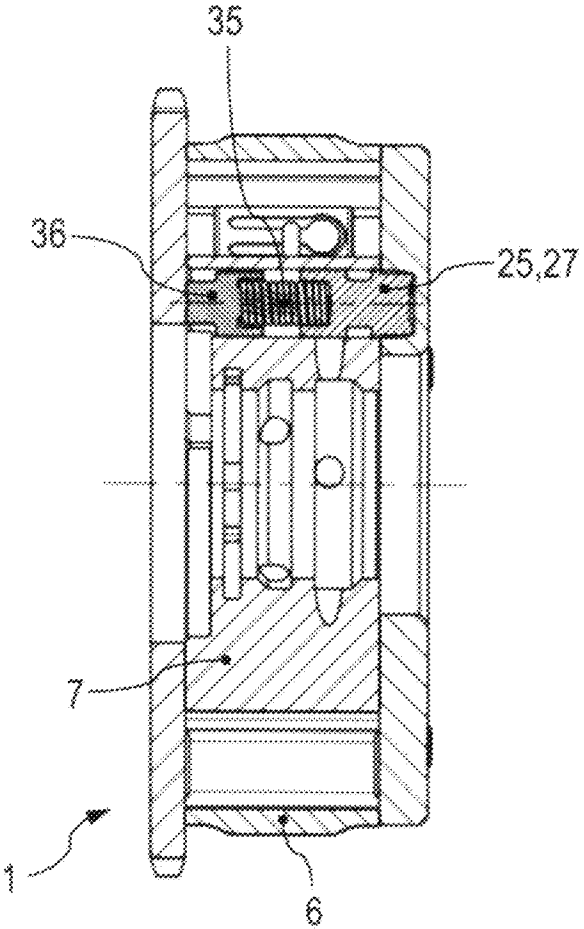
FIG. 12*a* shows a sectional view of the camshaft adjuster from FIG. 9 along line XII, in the locked state.

FIG. 12*a* shows the locked state, while FIG. 12*b* shows the unlocked state. Advance locking pin 27 is illustrated.

Figure 14:
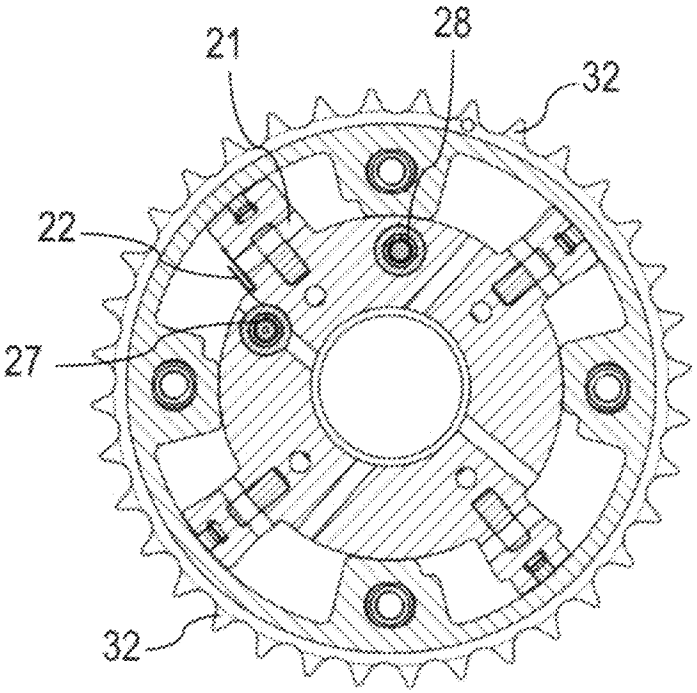
FIG. 14 shows a sectional view of the camshaft adjuster from FIG. 11*b* along line XIV, a transverse bore in the vane, namely the fluid connection, being blocked, unlike in the switching position shown in FIG. 13.
Figure 13:
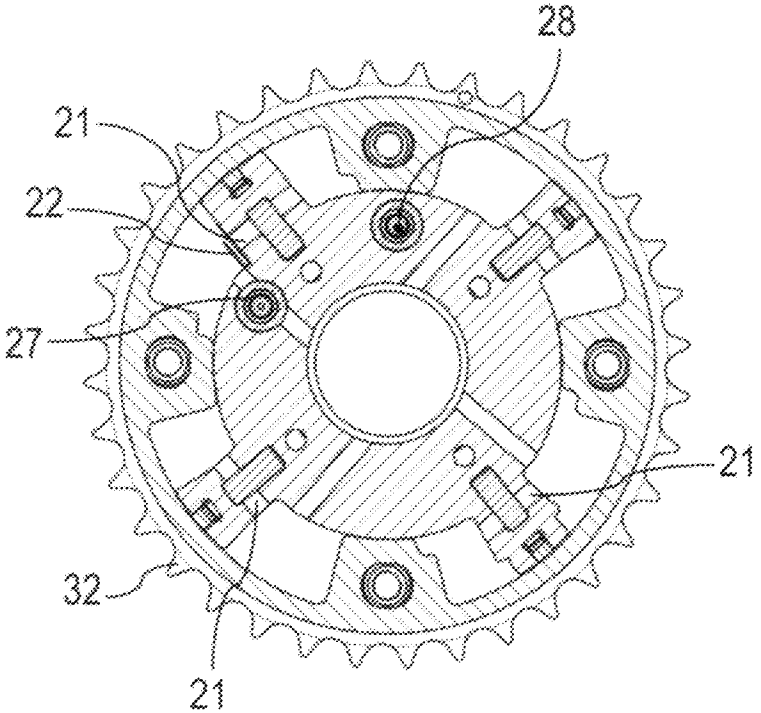
FIG. 13 shows a cross section of the camshaft adjuster from FIG. 11*a* along line XIII.

Fluid connection 21 is designed as a transverse bore, as is readily apparent from FIGS. 13 and 14. In FIG. 13, the transverse bore is open, although the camshaft adjuster is in the locked state. In FIG. 14, the camshaft adjuster is in the locked state, and the transverse bore is blocked.

Figure 15:
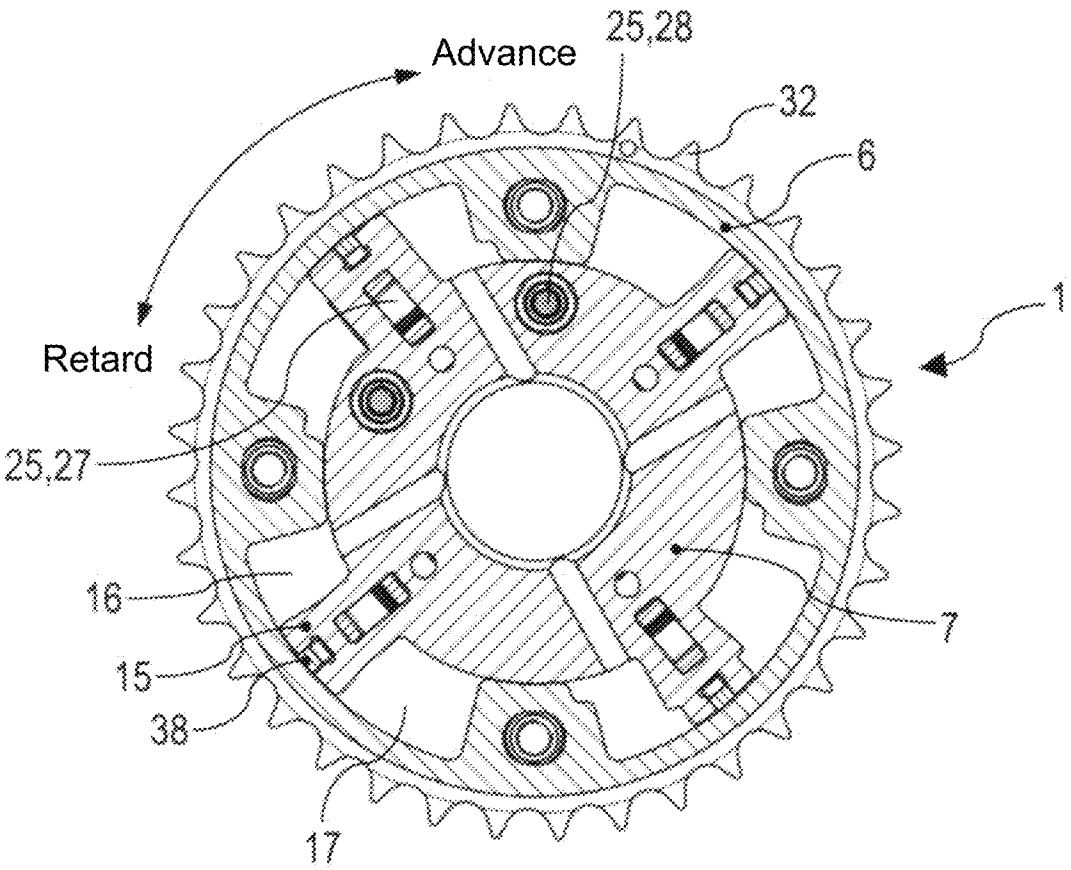
FIG. 15 shows a longitudinal sectional view of the camshaft adjuster from FIG. 11*a* or 11*b* along line XV.

The potential adjusting directions from ADVANCE to RETARD or from RETARD to ADVANCE are apparent from FIG. 15, reference being made to rubbing sealing elements 38 on the outer circumference of vanes 15.

Figure 17:
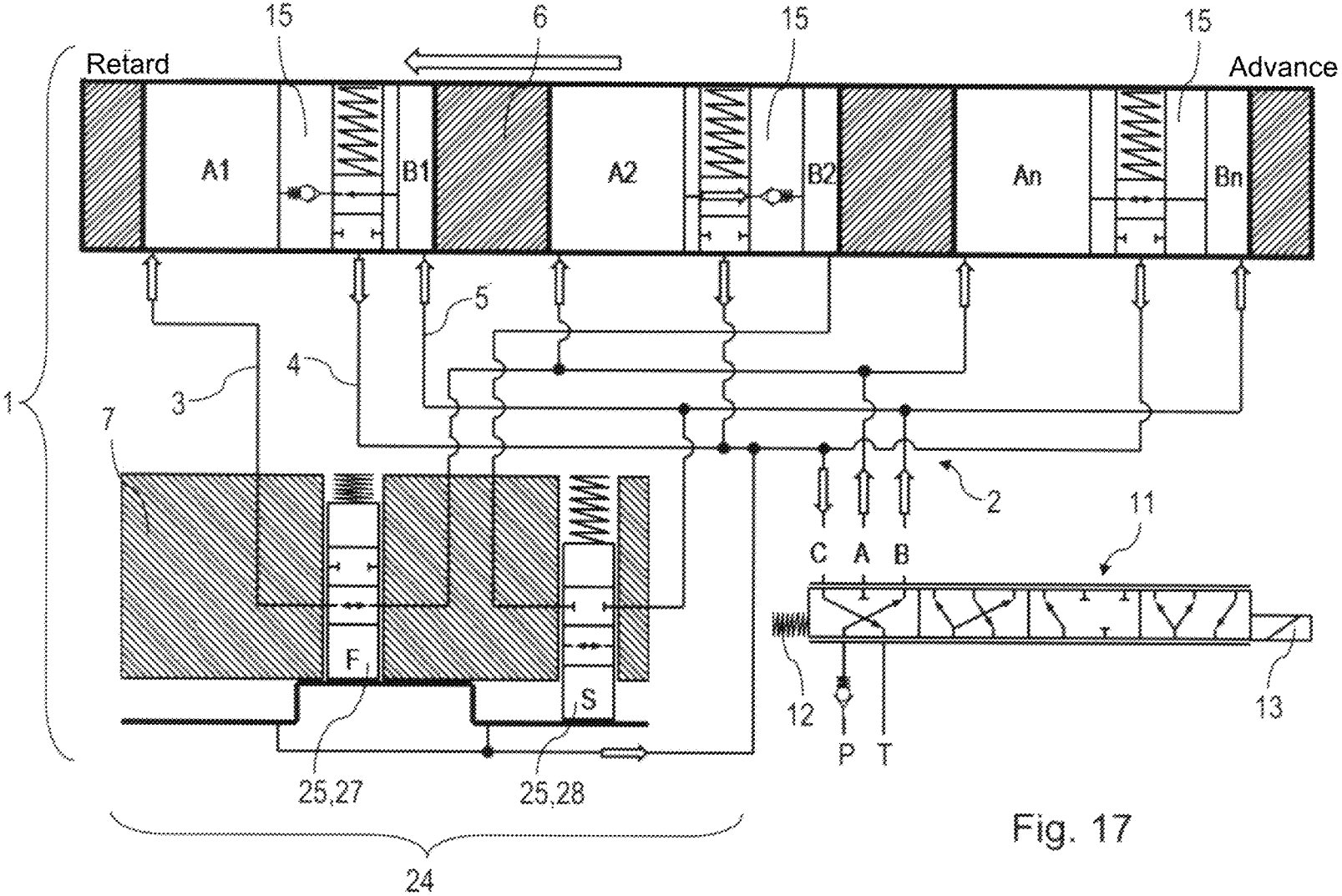
FIG. 17 shows a representation of the camshaft adjuster from FIG. 16 in a switching position during the locking operation from ADVANCE while the engine is stopped.
Figure 18:
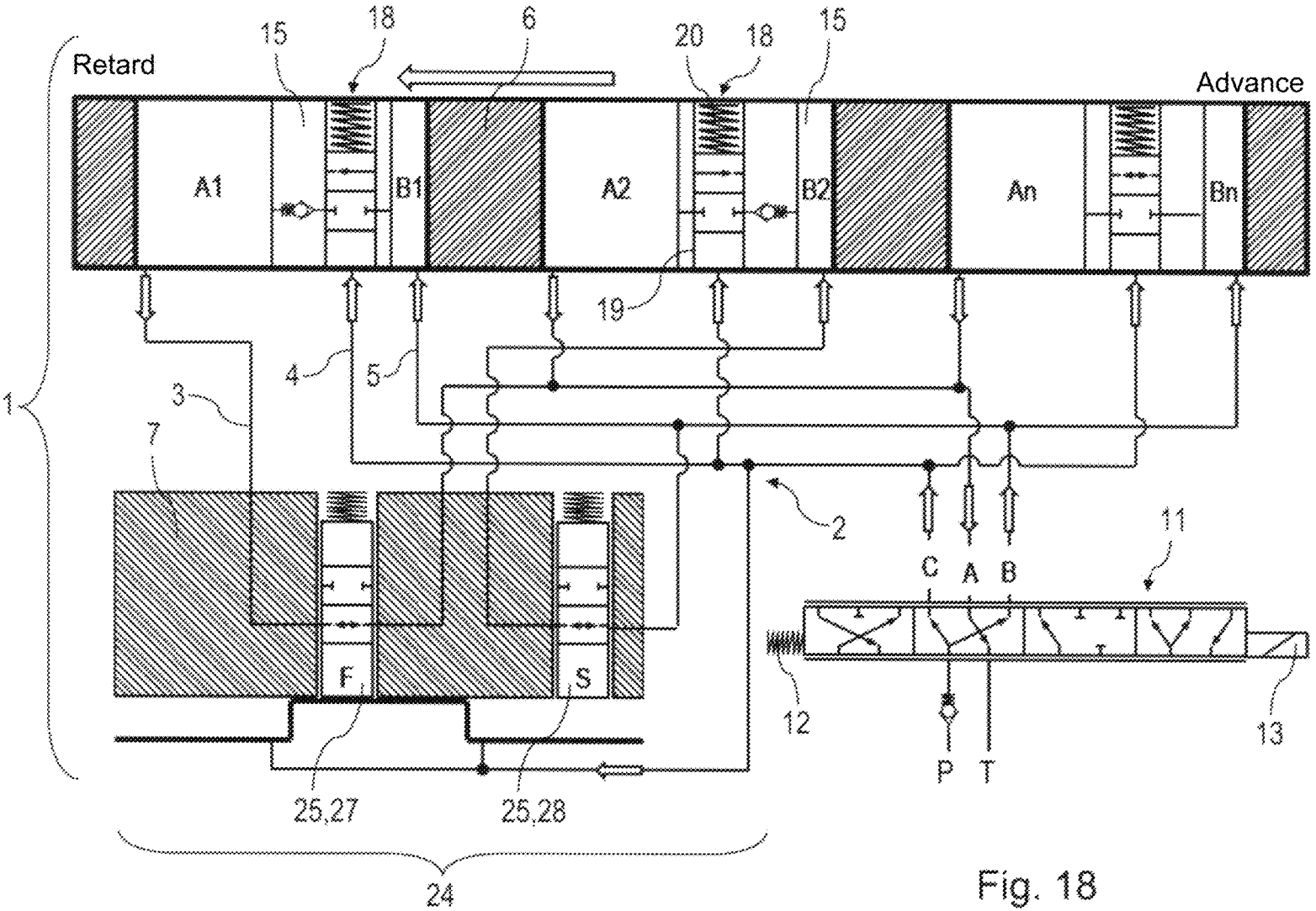
FIG. 18 shows the representation of the camshaft adjuster from the second exemplary embodiment during a normal adjustment from ADVANCE to RETARD while the internal combustion engine is running.

FIGS. 16 through 18 show a second exemplary embodiment, which differs from the first exemplary embodiment primarily in that second check valve 23 is inserted into a different vane 15 than first check valve 22.

The flow directions of the hydraulic medium, i.e., the oil, are shown by double-thick arrows over fluid connections 21 and particular hydraulic medium lines 3 through 5. The active principle corresponds to that of the first exemplary embodiment; however, a progression of the rotor into a position, i.e., the placement of vanes 15 into a center-locking position, is now possible in both directions. A hydraulic freewheeling in two directions is thus provided, which is selectively actuatable.

It is worth noting that retard locking pin 28 is also designed to interrupt a hydraulic medium line, namely third hydraulic medium line 5.

LIST OF REFERENCE NUMERALS

1 camshaft adjuster
2 hydraulic medium conducting system
3 first hydraulic medium line
4 second hydraulic medium line
5 third hydraulic medium line
6 stator
7 rotor
8 hydraulic medium supply and/or hydraulic medium discharge device
9 oil supply device
10 oil discharge device
11 hydraulic valve
12 spring element
13 electromagnet
14 chamber
15 vane
16 advance chamber
17 retard chamber
18 hydraulic medium control device
19 control piston
20 spring
21 fluid connection
22 first check valve
23 second check valve
24 locking device
25 locking pin/piston
26 recess
27 advance locking pin/locking piston
28 retard locking pin/locking piston
29 locking contour/locking gate
30 spring of the locking pin/locking piston
31 sealing cover
32 toothing
33 screw connection
34 projection
35 locking spring
36 cartridge
37 guiding element
38 sealing element

What is claimed is:

1. A vane-type hydraulic camshaft adjuster comprising:
a rotor;
a stator; and
a hydraulic medium conducting system, with the aid of the hydraulic medium conducting system at least two chambers separated by a rotor-fixed vane are connectable or connected to a hydraulic medium supply or hydraulic medium discharge device by interposing a hydraulic valve, a switchable hydraulic medium control device being present in the vane, the vane being is designed to selectively unblock and interrupt a fluid connection from one chamber to the other chamber of the at least two chambers, a locking device being present to prevent a rotational movement between the rotor and the stator, the locking device being designed to lock the rotor to the stator in a vane position, the one and other chambers in the vane position have volumes of approximately the same size, and the locking device having at least one pin able to establish a form-locked fit with a stator-fixed component such that contact between the at least one pin and the stator-fixed component fixes the at least one pin in the stator-fixed component together for rotation in both rotational directions the pin being designed to control the inflow or outflow of hydraulic medium to or from the one or the other chamber.

2. The hydraulic camshaft adjuster as recited in claim 1 wherein the locking device includes an advance locking pin and a retard locking pin, the pin being one of the advance locking pin and the retard locking pin.

3. The camshaft adjuster as recited in claim 2 wherein the stator-fixed component is designed as a sealing cover having at least one recess for the form-locked accommodation of the pin at least on one side.

4. The camshaft adjuster as recited in claim 2 wherein the advance locking pin is designed to engage with the stator-fixed component when the vane is in an ADVANCE adjustment position or in a central position, or the retard locking pin is designed to engage with the stator-fixed component when the vane is in a RETARD adjustment position or in the central position.

5. The camshaft adjuster as recited in claim 1 wherein the pin is a locking pin spring-preloaded in such a way that the pin is pushed out of the rotor in the absence of a counter-force.

6. The camshaft adjuster as recited in claim 2 wherein the advance locking pin is designed to interrupt a first hydraulic medium line to a chamber in the state in which the advance locking pin is extended out of the rotor.

7. The camshaft adjuster as recited in claim 1 wherein the switchable hydraulic medium control device includes a control piston having an oil conducting groove situated on its outer circumferential surface or internally.

8. The camshaft adjuster as recited in claim 6 wherein the control piston is spring-preloaded in such a way that the control piston is pushed into a position which unblocks the fluid connection in the absence of a counter-force, or via a second hydraulic medium line to the control piston upon the provision of hydraulic pressure, the control piston is pushed into a position which interrupts the fluid connection or the second hydraulic medium line is also situated or connected for the purpose of conducting hydraulic medium to the pin for the purpose of providing a counter-force against an existing spring, the pin being a locking pin.

9. The camshaft adjuster as recited in claim 1 wherein a first check valve is situated on or in the fluid connection in the vane for the purpose of preventing the hydraulic medium flow from the one chamber into the other chamber, or a second check valve is present in another vane in an active direction opposite that of the first check valve.

10. The camshaft adjuster as recited in claim 1 wherein the three or four or five vanes are equally distributed on the rotor.

11. The camshaft adjuster as recited in claim 1 wherein the pin is a locking pin.

* * * * *